US009050492B2

(12) United States Patent
Shifferaw

(10) Patent No.: US 9,050,492 B2
(45) Date of Patent: Jun. 9, 2015

(54) MACHINE FOR EXERCISING THE CORE MUSCLES

(75) Inventor: Tessema Dosho Shifferaw, Albany, CA (US)

(73) Assignee: 2014 Shifferaw Family Revocable Trust, El Cerrito, CA (US)

( * ) Notice: Subject to any disclaimer, the term of this patent is extended or adjusted under 35 U.S.C. 154(b) by 188 days.

(21) Appl. No.: 13/564,967

(22) Filed: Aug. 2, 2012

(65) Prior Publication Data

US 2014/0038796 A1 Feb. 6, 2014

(51) Int. Cl.

| | |
|---|---|
| ***A63B 21/00*** | (2006.01) |
| ***A63B 21/04*** | (2006.01) |
| ***A63B 21/055*** | (2006.01) |
| ***A63B 22/18*** | (2006.01) |
| ***A63B 23/02*** | (2006.01) |
| ***A63B 23/035*** | (2006.01) |
| *A63B 71/02* | (2006.01) |

(52) U.S. Cl.

CPC ..... *A63B 21/0421* (2013.01); *A63B 21/0552* (2013.01); *A63B 21/1465* (2013.01); *A63B 21/1492* (2013.01); *A63B 22/18* (2013.01); *A63B 23/0216* (2013.01); *A63B 23/03525* (2013.01); *A63B 2071/027* (2013.01); *A63B 2208/0247* (2013.01); *A63B 2225/09* (2013.01)

(58) Field of Classification Search

USPC ..... 482/95, 96, 146, 147, 71, 72, 130, 142, 482/136, 145

See application file for complete search history.

(56) References Cited

U.S. PATENT DOCUMENTS

| | | | | |
|---|---|---|---|---|
| 5,507,710 | A * | 4/1996 | Chen | 482/72 |
| 6,716,144 | B1 | 4/2004 | Shifferaw | |
| 6,821,235 | B1 * | 11/2004 | Johnson et al. | 482/79 |
| 7,137,933 | B2 | 11/2006 | Shifferaw | |
| 7,476,188 | B2 * | 1/2009 | Perez, Jr. | 482/142 |
| 2009/0017999 | A1 * | 1/2009 | Halbridge | 482/130 |
| 2011/0160026 | A1 * | 6/2011 | Perez, Jr. | 482/142 |

* cited by examiner

*Primary Examiner* — Jerome w Donnelly
(74) *Attorney, Agent, or Firm* — Edward S. Wright

(57) ABSTRACT

Machine for exercising the core muscles having a swiveling seat mounted on a base for receiving a person in a reclined position with his legs and torso extending in opposite directions, a pad for supporting the upper portion of the torso while the legs are swung back and forth in a horizontal direction, resilient means connected to the seat for resisting the swinging of the legs, and handles on opposite sides of the seat in position to be gripped by the person while he is swinging his legs.

20 Claims, 5 Drawing Sheets

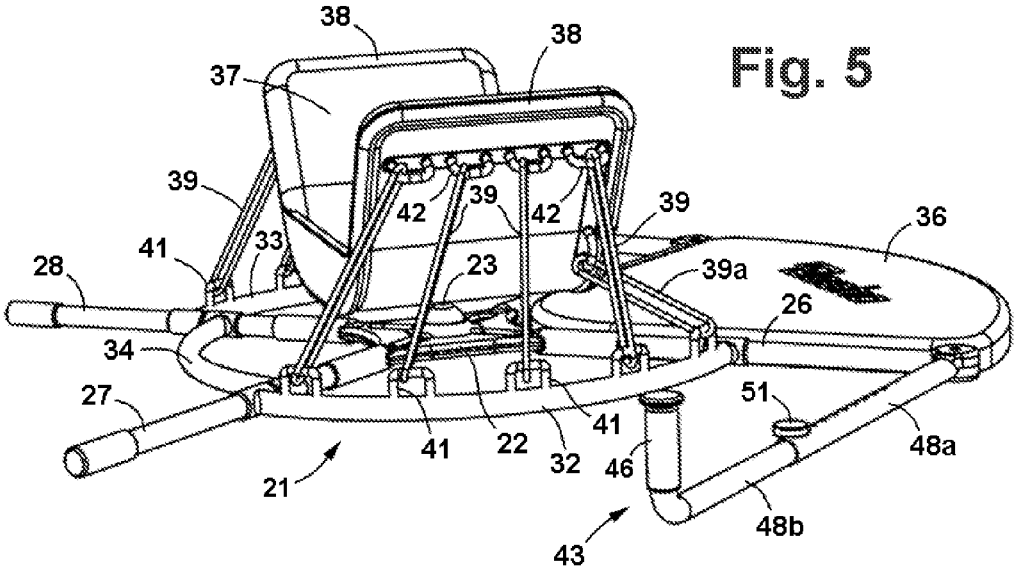
Fig. 5
Fig. 6
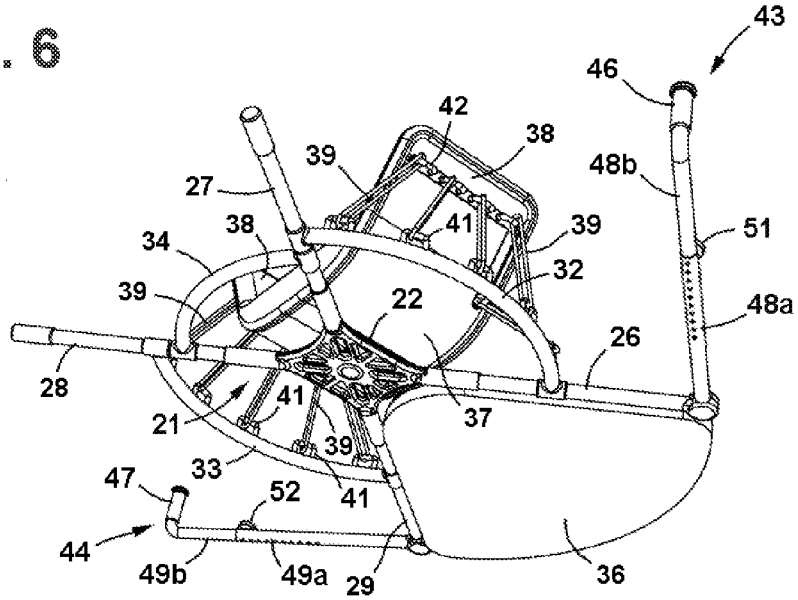

Fig. 9
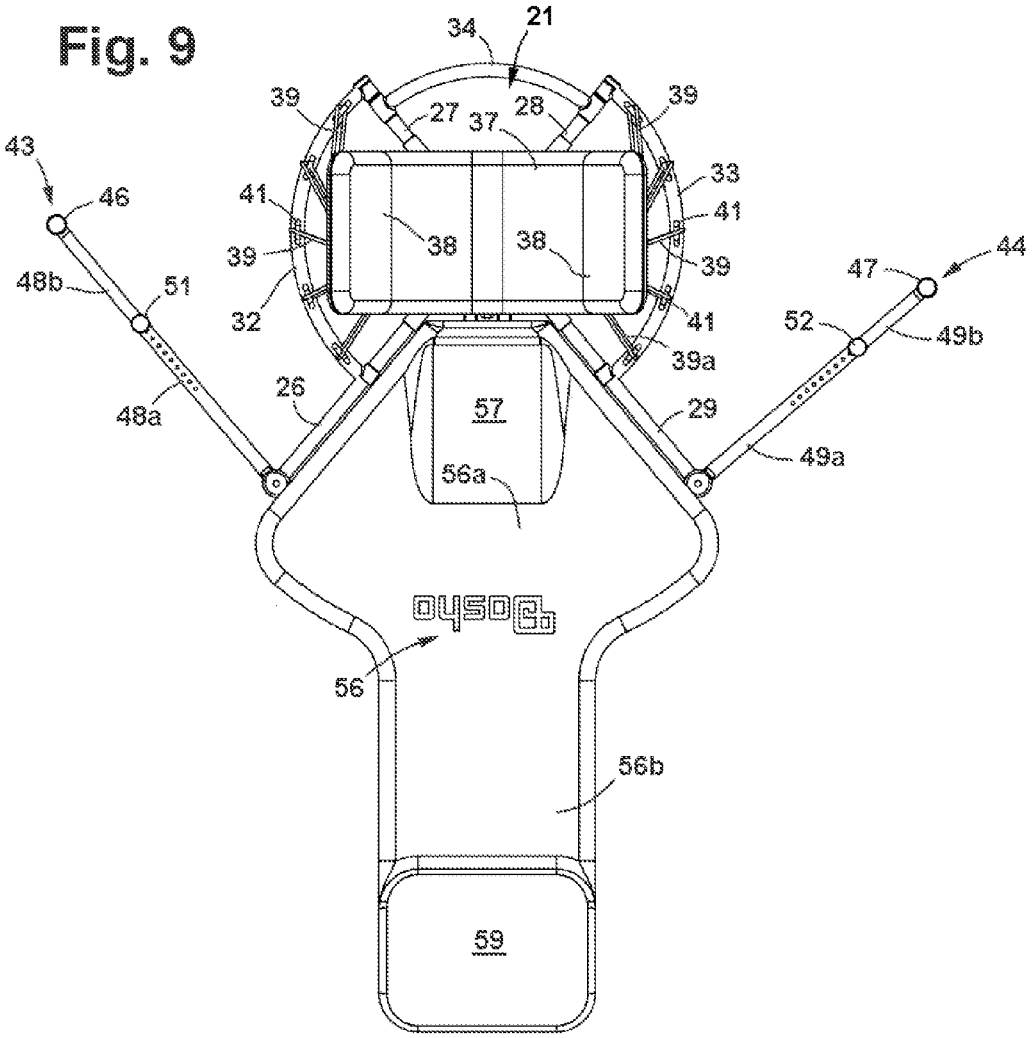
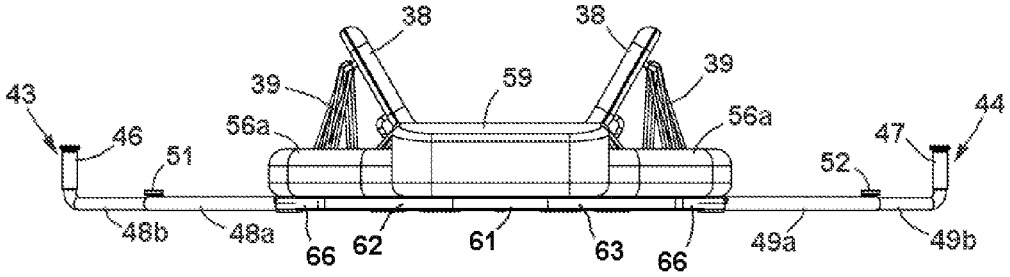
Fig. 10

MACHINE FOR EXERCISING THE CORE MUSCLES

BACKGROUND OF THE INVENTION

1. Field of Invention

This invention pertains generally to exercise and fitness and, more particularly, to a machine for exercising the core muscles.

2. Related Art

Core exercises target muscles in the abdomen, hips, lower back, and pelvis, and are an important part of a well-rounded fitness program. Often employed by physical therapists, core exercises are helpful in improving balance and stability, toning the midsection, improving posture, prevention of injury, recovery from injury, improving athletic performance, and reducing lower back pain.

OBJECTS AND SUMMARY OF THE INVENTION

It is, in general, an object of the invention to provide a new and improved machine for exercising the core muscles.

Another object of the invention is to provide a machine of the above character which overcomes the limitations and disadvantages of core exercisers heretofore provided.

These and other objects are achieved in accordance with the invention by providing a machine having a swiveling seat mounted on a base for receiving a person in a reclined position with his legs and torso extending in opposite directions, a pad for supporting the upper portion of the torso while the legs are swung back and forth in a horizontal direction, resilient means connected to the seat for resisting the swinging of the legs, and handles on opposite sides of the seat in position to be gripped by the person while he is swinging his legs.

BRIEF DESCRIPTION OF THE DRAWINGS

FIG. 5 is a top, front isometric view of the embodiment of FIG. 1.

FIG. 6 is bottom, front isometric view of the embodiment of FIG. 1.

FIG. 9 is a top plan view of the embodiment of FIG. 7.

FIG. 10 is a rear elevational view of the embodiment of FIG. 7.

DETAILED DESCRIPTION

Figure 1:
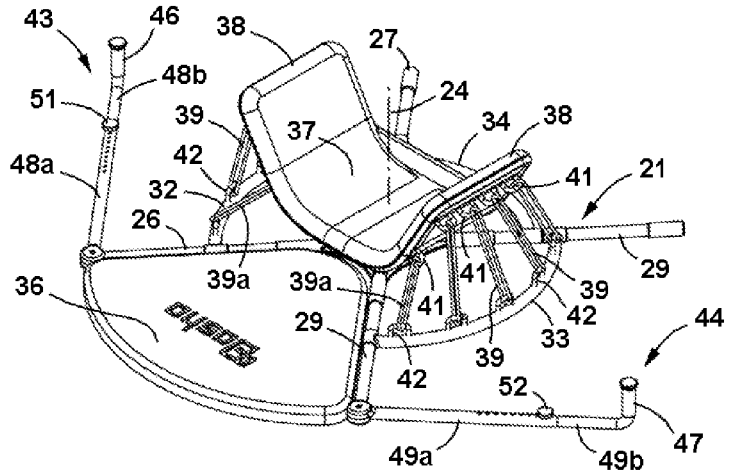
FIG. 1 is a top, rear isometric view of one embodiment of a machine for exercising the core muscles in accordance with the invention.
Figure 2:
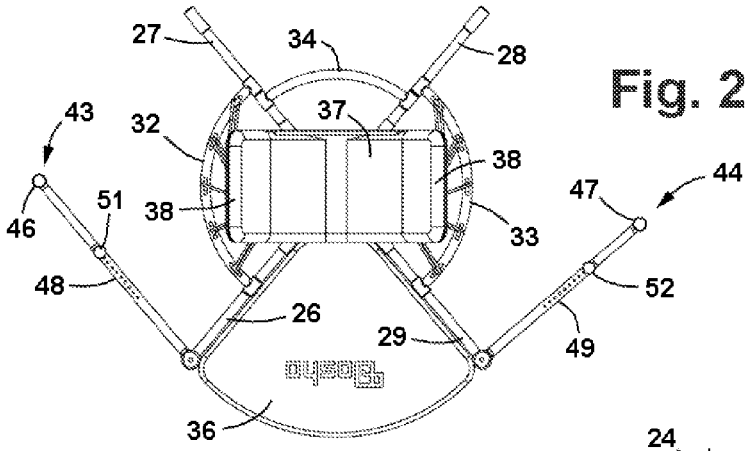
FIG. 2 is a top plan view of the embodiment of FIG. 1.
Figure 3:
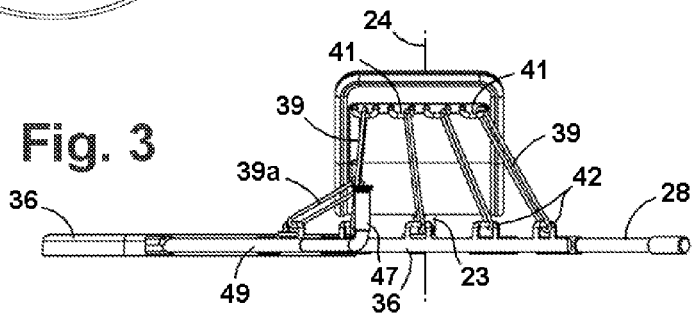
FIG. 3 is a side elevational view of the embodiment of FIG. 1.
Figure 4:
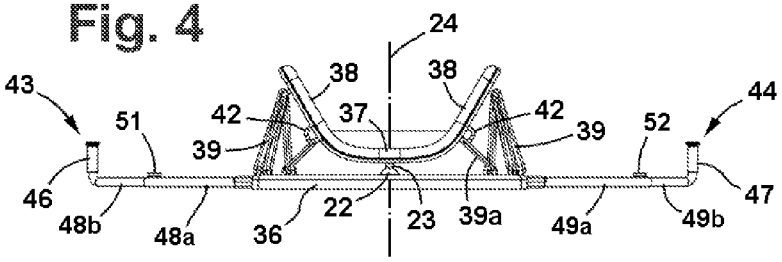
FIG. 4 is a rear elevational view of the embodiment of FIG. 1.
Figure 7:
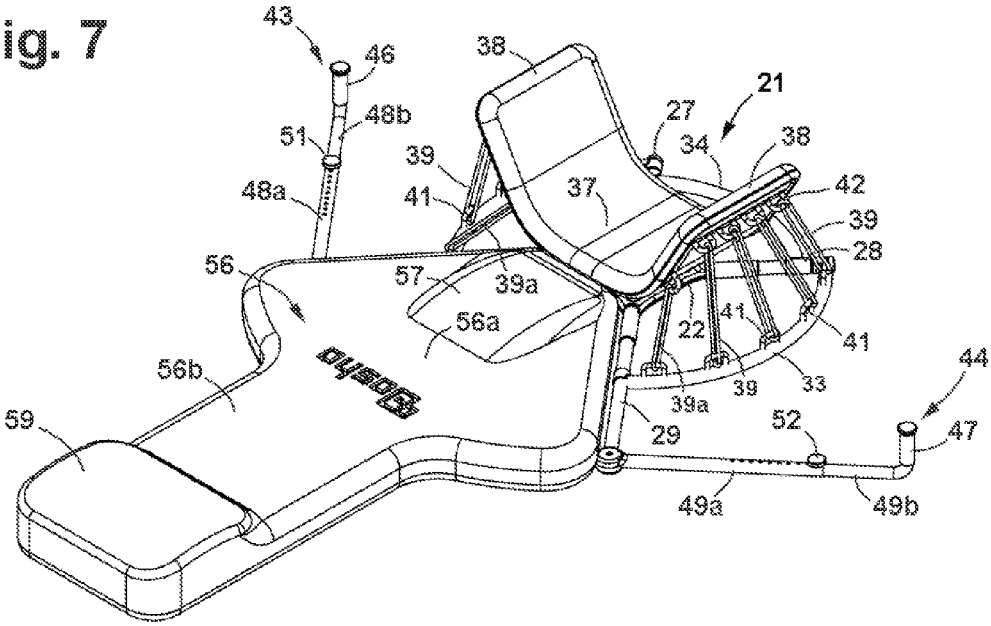
FIG. 7 is a top, rear isometric view of another embodiment of a machine for exercising the core muscles in accordance with the invention.
Figure 8:
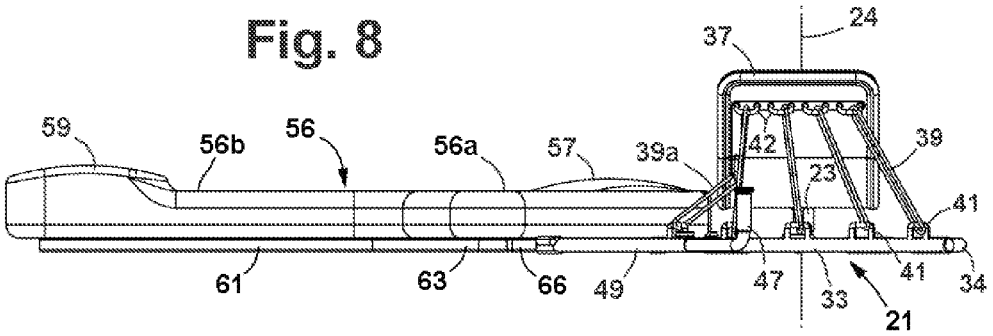
FIG. 8 is a side elevational view of the embodiment of FIG. 7.
Figure 11:
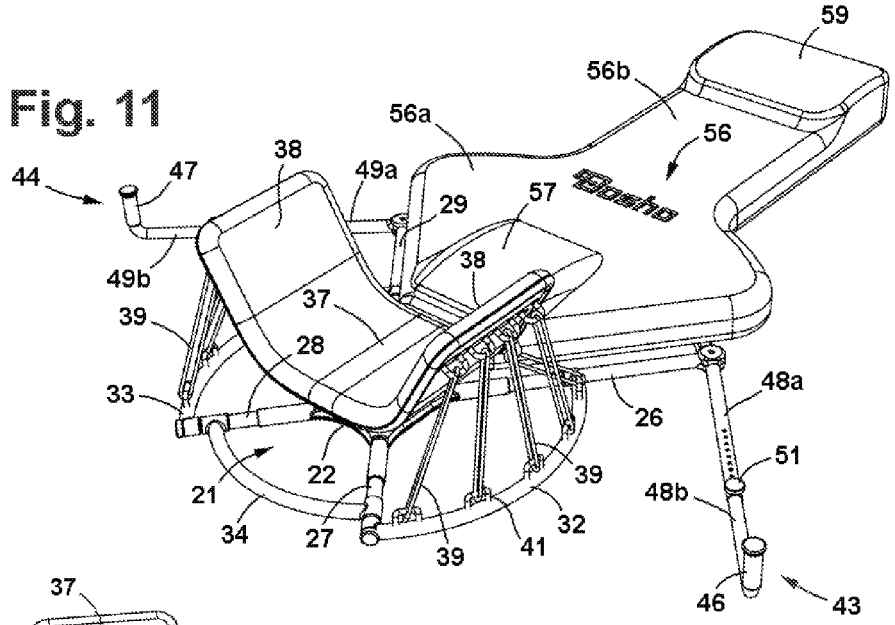
FIG. 11 is a top, front isometric view of the embodiment of FIG. 7.
Figure 12:
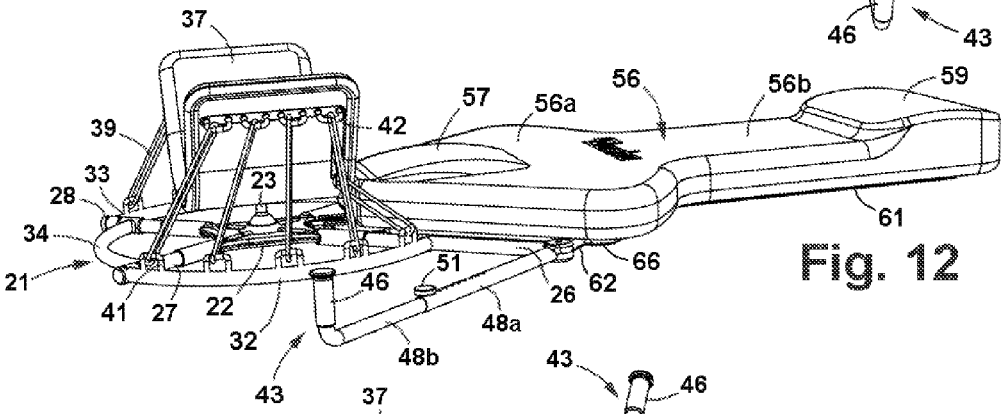
FIG. 12 is a top, side isometric view of the embodiment of FIG. 7.

In the embodiment of FIGS. 1-6, the machine for exercising the core muscles has a base 21 which rests upon a supporting surface (not shown). The base includes a swivel assembly 22 with a vertically extending chair post 23 that rotates about its vertically extending axis 24. The base also includes a plurality of frame members or legs 26-29 which extend in radial directions from the swivel assembly. The frame members or legs are spaced approximately in quadrature about the post and are rigidly affixed to the swivel assembly by suitable means such as screws or welding.

Arcuately extending frame members 32, 33 extend between frame members 26, 27 and 28, 29 on opposite sides of the base, with a brace 34 between frame members 27, 28 toward the front of the base and a horizontally extending, sector-shaped pad 36 between frame members 26, 29 toward the rear. The arcuate frame members and brace are disposed concentrically about axis 24.

A U-shaped cradle or seat 37 is mounted on swivel post 23 for rotation about swivel axis 24. The U-shaped cradle or seat has upwardly and outwardly inclined side walls or wings 38, 38 on opposite sides thereof and is adapted for receiving and supporting the lower torso or buttocks of a person using the machine in a reclined position, with the upper torso and legs extending in opposite directions from the seat.

Means is provided for urging the cradle or seat toward a rest position and resisting movement of the cradle or seat away from that position. This means comprises a plurality of elastic cords 39 that are connected between the cradle or seat and the base of the machine. The cords are in the form of loops or bands which are looped about hooks 41, 42 on the sides of the seat and the arcuate frame members 32, 33 of the base. In the embodiment illustrated, five elastic bands are spaced apart along each side of the seat and the frame member on that side of the seat, with the rearmost band 39*a* on each side being connected to a lower point on the seat than the other bands.

Handles 43, 44 which can be grasped by the hands of a person using the machine are provided on each side of the seat. The handles include vertically extending hand grips 46, 47 at the outer ends of horizontally extending arms 48, 49. The inner ends of the arms are pivotally connected to the outer ends of frame members 26, 29 so that the grips can be positioned closer to or farther from the body. The arms are also axially extensible, with telescoping sections 48*a*, 48*b* and 49*a*, 49*b* and thumbscrews 51, 52 which permit the length of the arms to be adjusted.

In using the machine, a person can recline on seat 37 and pad 36, with the buttocks or lower portion of his torso resting on the seat, the upper portion of the torso resting on the pad to the rear of the seat, and his legs extending from the front of the seat. To exercise the core muscles, the person grips handles 43, 44 and swings his elevated legs back and forth in a horizontal direction, which causes the seat to pivot back and forth about the swivel axis. Movement of the seat and, hence, the legs of the exerciser is resisted by the resistance cords 39 connected between the seat and the frame members of the base, with the degree of resistance being determined by the number and strength of the cords.

The level of difficulty also depends upon the position of the legs and the placement of the arms. As the legs are elevated more, the difficulty of swinging them from side to side also increases. Extending the arms out away from the body decreases the difficulty of swinging the legs, whereas bringing them in closer to the body increases the difficulty.

Although the invention has been described with reference to a user who is lying on his back in a supine position, some users may prefer to use the machine in a prone position or while lying on their sides, and the term reclined, as used herein, includes any position in which the user is lying on the seat and pad.

The embodiment of FIGS. 7-13 is similar to the embodiment of FIGS. 1-6, and like reference numerals designate corresponding elements in the two. In the embodiment of FIGS. 7-13, however, the support pad 56 has an inner, sector-shaped section 56*a* that extends beyond frame members 26, 29 for supporting the back or torso and a generally rectangular outer section 56*b* that extends in a radial direction to the rear of the inner section for supporting the head and neck of a user.

Pad 56 includes a lumbar support cushion 57 and a neck or headrest cushion 59 for further supporting the lower back, neck, and head of a person using the machine. The lumbar cushion is positioned toward the front of the pad, just behind the seat, and the neck/head cushion is positioned toward the outer or rear end of the rectangular section of the pad.

Figure 13:
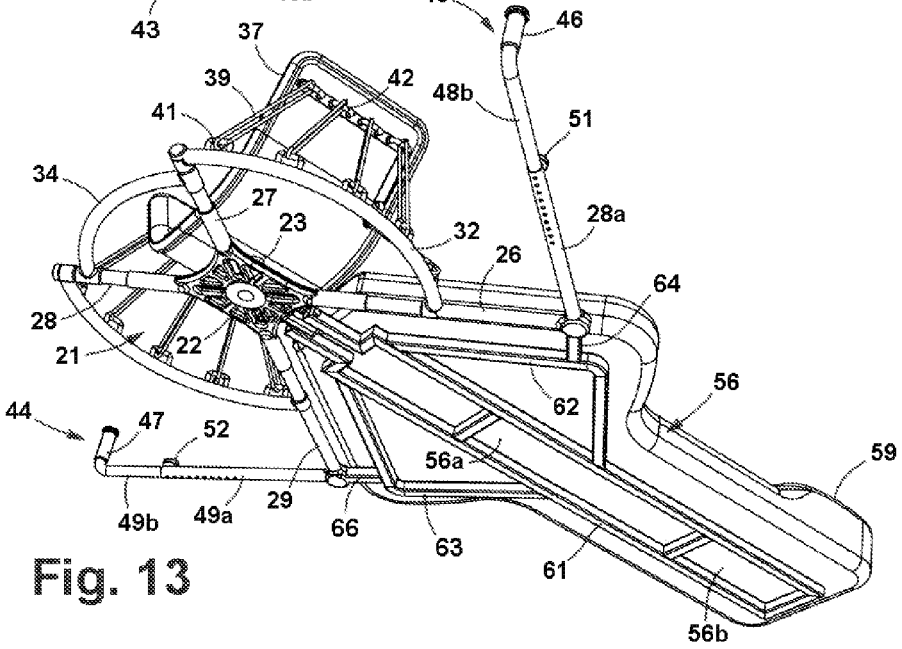
FIG. 13 is a bottom, front isometric view of the embodiment of FIG. 7.

As best seen in FIG. 13, pad 56 rests on and is supported by a frame having a generally rectangular section 61 that extends rearwardly from swivel assembly 22, beneath the inner and outer sections of the pad, and wing sections 62, 63 that extend laterally from the rectangular section beneath the side portions of the sector-shaped inner section. Braces 64, 66 extend between wing sections 62, 63 and the outer end portions of frame members 26, 29.

Operation and use of the embodiment of FIGS. 7-13 is similar to that of the embodiment of FIGS. 1-6. However, in the embodiment of FIGS. 7-13, cushion 57 provides additional support for the lower back and further helps to avoid back strain, and cushion 59 supports the head in an elevated position and prevents neck strain.

The invention has a number of important features and advantages. It utilizes side to side swinging movement of the user's elevated legs to work the core muscles, including the obliques, lower abs, upper abs, buttocks, and thighs, and the unique design of the machine ensures correct form while exercising to eliminate neck and back strain.

Unlike other machines that target only some of the core muscles, the invention rotates the entire core in a fun, sweeping motion for a total core workout. The machine can be used in many different positions, and the level of difficulty is readily controlled by the positioning of the arms and legs. The machine is easy to use, highly portable, and takes up very little space.

It is apparent from the foregoing that a new and improved machine for exercising the core muscles has been provided. While only certain presently preferred embodiments have been described in detail, as will be apparent to those familiar with the art, certain changes and modifications can be made without departing from the scope of the invention as defined by the following claims.

The invention claimed is:

1. Apparatus for exercising the core muscles, comprising a swivel base having a vertically extending post that rotates about a vertically extending axis, an upwardly facing cradle mounted on the post for receiving the lower torso of an exerciser in a reclined position and rotating back and forth in a horizontal plane about the vertically extending axis as the exerciser swings his legs back and forth in a horizontal direction, and resilient means connected to the cradle for resisting the swinging of the legs.

2. The apparatus of claim 1 further comprising handles on opposite sides of the cradle in position to be gripped by the exerciser.

3. Apparatus for exercising the core muscles, comprising a swivel base, an upwardly facing cradle mounted on the swivel base for receiving the lower torso of an exerciser in a reclined position and rotating back and forth about a vertically extending axis as the exerciser swings his legs back and forth in a horizontal direction, resilient means connected to the cradle for resisting the swinging of the legs, and handles on opposite sides of the cradle in position to be gripped by the exerciser, the handles being attached to pivotally mounted horizontally extending arms that can be moved to different positions to position the handles at different distances from the cradle.

4. The apparatus of claim 3 wherein the arms are adjustable in length.

5. Apparatus for exercising the core muscles, comprising a swivel base, an upwardly facing cradle mounted on the swivel base for receiving the lower torso of an exerciser in a reclined position and rotating back and forth about a vertically extending axis as the exerciser swings his legs back and forth in a horizontal direction, a horizontally extending pad on one side of the cradle for supporting the back of the exerciser, and resilient means connected to the cradle for resisting the swinging of the legs.

6. The apparatus of claim 5 wherein the pad includes a lumbar support cushion near the cradle.

7. The apparatus of claim 5 wherein the pad includes a headrest cushion positioned away from the cradle.

8. The apparatus of claim 1 including a horizontally extending frame to which the swivel base is attached.

9. Apparatus for exercising the core muscles, comprising a swivel base, an upwardly facing cradle mounted on the swivel base for receiving the lower torso of an exerciser in a reclined position and rotating back and forth about a vertically extending axis as the exerciser swings his legs back and forth in a horizontal direction, a horizontally extending frame including a pair of arcuately extending frame members on opposite sides of the cradle to which the swivel base is attached, and resilient means connected between the arcuately extending frame members and the cradle for resisting the swinging of the legs.

10. Apparatus for exercising the core muscles, comprising a swiveling seat mounted on a base for rotation about a vertically extending axis and for receiving a person in a reclined position with his legs and torso extending in opposite directions, a horizontally extending pad for supporting the upper portion of the torso while the legs are swung back and forth in a horizontal direction, resilient means connected to the seat for resisting the swinging of the legs, and handles on opposite sides of the seat in position to be gripped by the person while he is swinging his legs.

11. The apparatus of claim 10 wherein the handles can be selectively positioned closer to and farther from the seat.

12. The apparatus of claim10 wherein the seat is U-shaped.

13. The apparatus of claim 10 including a pair of arcuately extending frame members affixed to the base on opposite sides of the seat, with the resilient means for resisting the swinging of the legs being connected between the arcuately extending frame members and the seat.

14. Apparatus for exercising the core muscles, comprising a swivel base, a U-shaped seat mounted on the base for rotation about a vertically extending axis, a plurality of horizontal frame members extending radially from the base, arcuately extending frame members disposed concentrically about the axis and connected between two of the radially extending frame members on opposite sides of the base, and resilient means connected between the seat and the arcuately extending frame members for resisting rotation of the seat about the axis.

15. The apparatus of claim 14 wherein the resilient means comprises a plurality of elastic cords spaced apart along the arcuately extending frame members.

16. The apparatus of claim 14 including a horizontally extending pad between two of the radially extending frame members for supporting the upper torso of a person reclining on the seat and swinging his legs back and forth in a horizontal direction.

17. The apparatus of claim 16 including a lumbar support on the pad near the seat.

18. The apparatus of claim 16 including a head rest on the pad away from the seat.

19. The apparatus of claim 14 including horizontally extending arms attached to two of the radially extending frame members and hand grips attached to the arms.

20. The apparatus of claim 19 wherein the arms are pivotally connected to the frame members, and the hand grips extend upwardly from free ends of the arms.

* * * * *